US005440286A

United States Patent [19]

Pikul et al.

[11] Patent Number: 5,440,286

[45] Date of Patent: Aug. 8, 1995

[54] ELECTRICAL TRANSFORMER STRUCTURE WITH COIL COVERS

[75] Inventors: Henry Pikul; Joseph S. Droho, both of Chicago, Ill.; John A. Larson, Portage, Wis.; Dale C. McClurg, Grayslake, Ill.

[73] Assignee: North American Philips Corporation, New York, N.Y.

[21] Appl. No.: 236,692

[22] Filed: Mar. 8, 1994

Related U.S. Application Data

[63] Continuation of Ser. No. 853,891, Mar. 19, 1992, abandoned, which is a continuation of Ser. No. 675,226, Mar. 26, 1991, abandoned.

[51] Int. Cl.[6] ..... H01F 27/30

[52] U.S. Cl. ..... 336/160; 336/198; 336/206

[58] Field of Search ..... 336/196, 198, 208, 160, 336/165, 209

[56] References Cited

U.S. PATENT DOCUMENTS

| | | | |
|---|---|---|---|
| 2,092,779 | 9/1937 | Rietmann | 336/196 |
| 2,311,450 | 2/1943 | Marsh | 336/198 |
| 2,385,460 | 9/1945 | Omansky | 336/165 |
| 2,858,514 | 10/1958 | Henderson et al. | 336/209 |
| 2,902,661 | 9/1959 | Henderson | 336/196 |
| 3,213,397 | 10/1965 | Broverman | 336/198 |
| 3,576,508 | 4/1991 | Liberman | 336/165 |
| 3,909,761 | 9/1975 | Miles | 336/209 |
| 4,000,483 | 12/1976 | Cook et al. | 336/198 |
| 4,216,455 | 8/1980 | Hester | 336/160 |
| 4,443,777 | 4/1984 | Koike | 336/198 |
| 4,812,798 | 3/1989 | Chappel | 336/198 |

*Primary Examiner*—Thomas J. Kozma
*Attorney, Agent, or Firm*—Brian J. Wieghaus

[57] ABSTRACT

A transformer in which the primary coil and the secondary coil are insulated from the iron laminations which form part of its flux paths by insulated covers which snap-on to the primary and secondary coils.

8 Claims, 3 Drawing Sheets

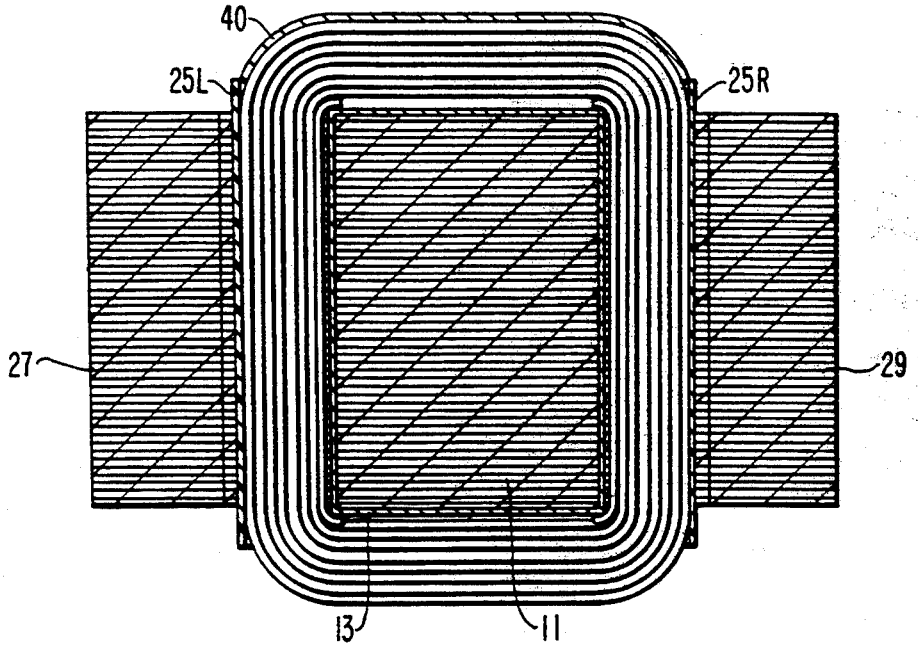
FIG. 5
FIG. 4
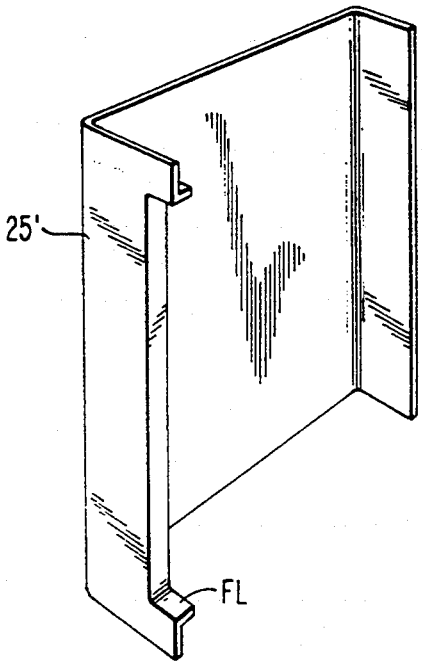

ELECTRICAL TRANSFORMER STRUCTURE WITH COIL COVERS

This is a continuation of application Ser. No. 07/853,891, filed Mar. 19, 1992, now abandoned, which is a continuation of application Ser. No. 07/675,226, filed on Mar. 26, 1991, now abandoned.

BACKGROUND OF THE INVENTION

This is an invention in the electromechanical art. More particularly, it involves an arrangement for an electrical transformer which is significantly less costly than previous arrangements for such transformers.

SUMMARY OF THE INVENTION

It is an object of this invention to provide improved transformers for use in ballast systems for gas discharge lamps.

One of the advantages of the invention is that it simplifies the manufacturing process involved in producing ballast transformers for gas discharge lamps.

One of the features of the invention is the provision of snap-on type insulators for the sides of the coils of ballast transformers for gas discharge lamps.

Another feature of the invention is the provision of insulating paper around the core of ballast transformers for gas discharge lamps.

In carrying out the invention there is provided a transformer including a primary coil and a secondary coil. A T-shaped laminated iron core is located inside both the primary and the secondary coil. The laminated iron core is insulated from both coils by an insulation paper surrounding a substantial length of the leg of said T-shaped core. The coils have an external front and an external back and two external sides. Plastic insulated covers are fitted over the front, the back and both sides of each coil. Two laminated iron bars are located adjacent the insulated covers. Laminated iron shunts are located between the primary coil and the secondary coil and complete the flux path for both coils in conjunction with the iron core and the two iron bars.

BRIEF DESCRIPTION OF THE DRAWINGS

Other objects, features and advantages of the invention will be apparent from the following description and appended claims when considered in conjunction with accompanying drawing in which:

FIG. 4 is an alternate embodiment of a snap-on type insulator used in the invention; and FIG. 5 is a view of the constructed embodiment of the invention of FIG. 2 taken along line 5—5.

DESCRIPTION OF THE PREFERRED EMBODIMENTS

Figure 1:
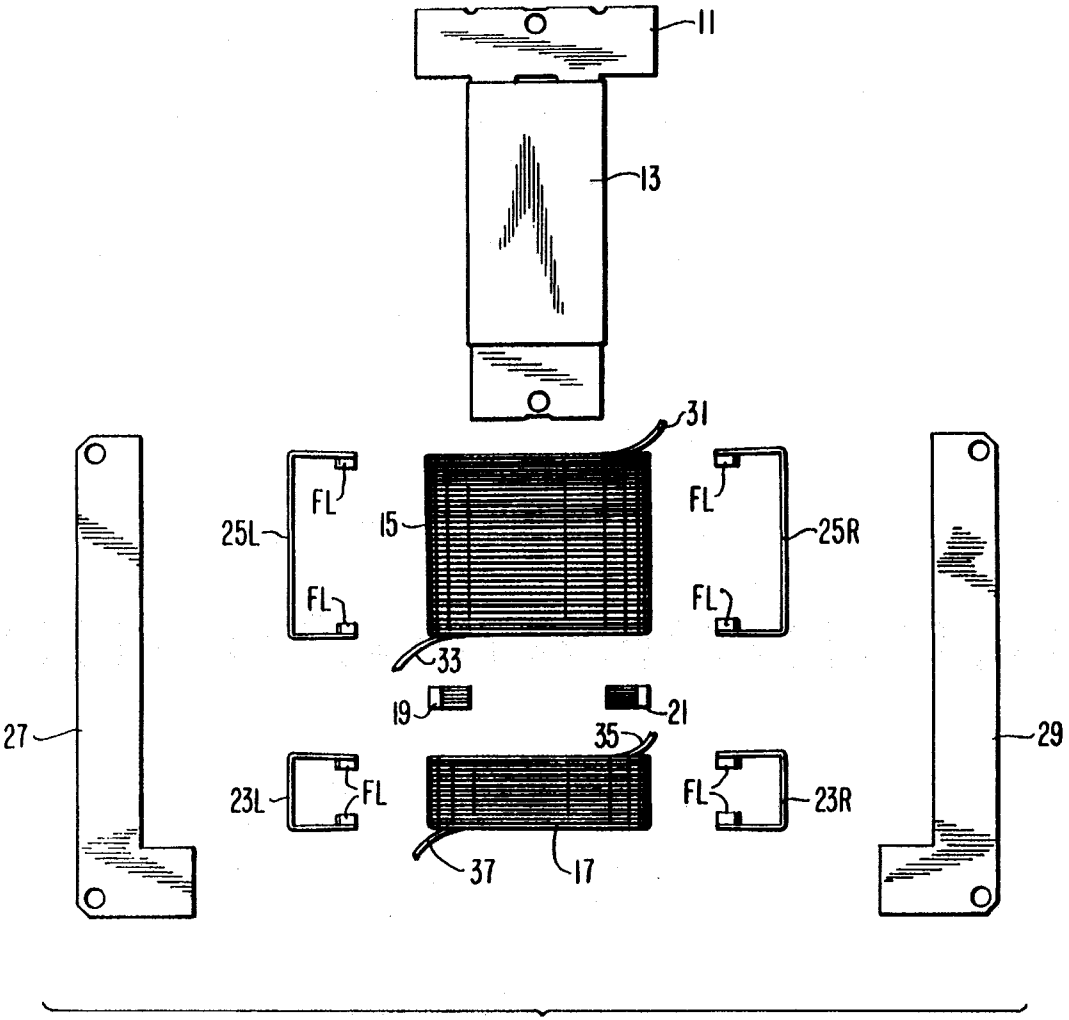
FIG. 1 is an exploded plan view of parts of the invention.

Referring to FIG. 1, there is shown a T-shaped laminated iron core 11. A substantial length of the leg of core 11 is surrounded by insulation paper 13. As constructed the leg of core 11 is inserted into the central apertures of secondary coil 15 and primary coil 17. Located between coils 15 and 17 are laminated iron shunts 19 and 21. Fastened to the right hand and left hand sides of primary coil 17 are plastic snap-on type insulators 23R and 23L respectively. As shown in FIG. 1, each insulator 23R and 23L has two flanges FL. Fastened to the right hand side and left hand side of secondary coil 15 are plastic snap-on type insulators 25R and 25L. Each of these insulators also has two flanges FL. Completing the flux paths for the transformer are two L-shaped laminated iron bars 27 and 29.

As is to be understood, insulation paper 13 provides insulation between the leg of core 11 and the internal surfaces of primary winding 17 and secondary winding 15. Snap-on type insulators 23R and 23L provide insulation between both legs of L-shaped iron bars 29 and 27 and the front and sides of primary winding 17. Insulators 23R and 23L also provide insulation between the back of primary winding 17 and shunts 19 and 21. Snap-on type insulators 25R and 25L insulate the sides of the secondary coil 15 from the long legs of L-shaped bars 29 and 27, respectively. Insulators 25R and 25L also insulate the front of secondary coil 15 from shunts 21 and 19. The back of secondary coil 15 is insulated from the head of T-shaped core 11 by insulators 25R and 25L.

Wires 31, 33, 35 and 37 illustrate one manner in which leads may be brought out from coils 15 and 17, respectively.

Figure 3:
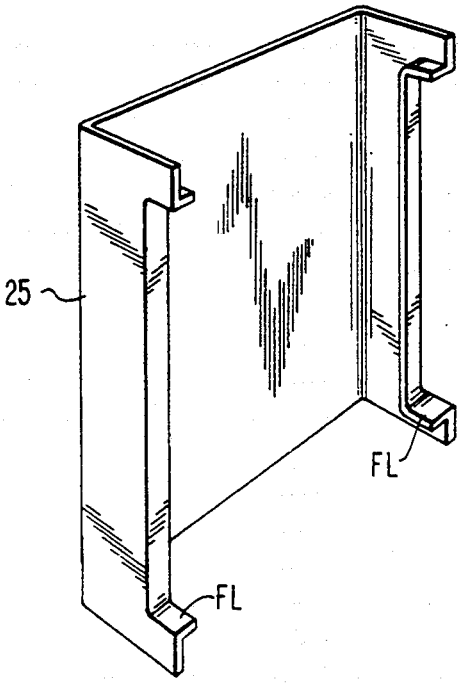
FIG. 3 is one embodiment of a snap-on type insulator used in the invention.

FIG. 3 is an enlarged perspective view of one of insulators 25R or 25L for secondary coil 15. As can be seen it has a flange FL on each of its side legs. An alternative to insulator 25 of FIG. 3 is insulator 25' of FIG. 4. As can be seen it has a flange FL on only one of its side legs.

Figure 2:
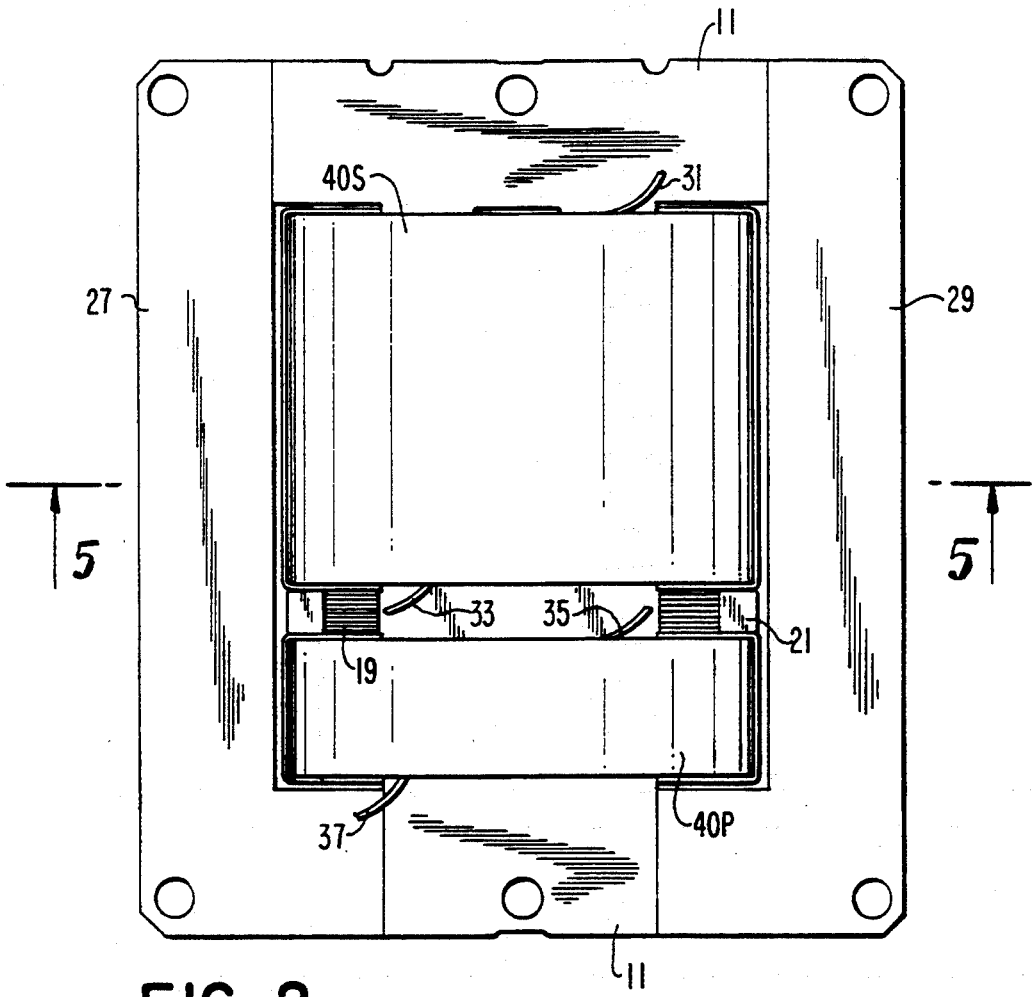
FIG. 2 is a plan view of a constructed version of the invention.

In FIG. 5 a cross-section of the invention taken along line 5—5 of FIG. 2 clearly demonstrates that the insulation 13 surrounds laminated core 11.

To insulate the tops and bottoms of coils 15 and 17 from the metal container normally provided for holding the coils, an insulating tape such as 40p and 40s in FIG. 2 and 40 in FIG. 5 is provided. (The bottom tape is not shown in FIG. 5, nor the top tapes 40p and 40s in FIG. 1 to simplify the drawing.)

It should be apparent that various modifications of the above will be evident to those skilled in the art and that the arrangement described herein is for illustrative purposes and is not to be considered restrictive.

What is claimed is:

1. A transformer, comprising: a primary coil, a secondary coil, a laminated iron core having a leg inside said coils, an insulated paper surrounding a substantial length of the leg of said core, said coils having an external front, an external back and two external sides, plastic insulated covers fitted over the front, the back and both sides of each coil, each of said coils being free of an internal coil bobbin on which said coil is wound, two laminated iron bars adjacent said insulated covers and two laminated iron shunts between said primary coil and said secondary coil, said shunts completing the flux paths for said coils in conjunction with said iron core and said two iron bars and wherein each insulated cover comprises a snap-on type insulator, each plastic insulated cover being shaped like a U with two side legs and a flange forming one continuous piece on the inside of said U with at least one of said side legs by which flange each said cover is fitted tightly against the front, the back and both sides of its associated coil after each said cover is snapped on to its associated coil.

2. A transformer in accordance with claim 1, wherein said insulated covers insulate the back of said primary coil and the front of said secondary coil from said two shunts.

3. A transformer in accordance with claim 1, wherein each plastic insulated cover has a flange on each of its side legs on the inside of said U.

4. An apparatus, comprising: an electric coil having an external front, an external back and two external sides with two one-piece plastic insulation covers, each cover being fitted over the front, the back and a respective side of the coil, said coil being free of an internal coil bobbin on which said coil is wound, and wherein each plastic insulation cover comprises a snap-on type insulator, each plastic insulation cover being shaped like a U with two side legs and a flange forming one continuous piece on the inside of said U with at least one of said side legs by which flange each said cover is fitted tightly against the front, the back and both sides of said coil after each said cover is snapped on to said coil.

5. The apparatus in accordance with claim 4, wherein each plastic insulated cover has a flange on each of its two side legs on the inside of said U.

6. A transformer, comprising:

a primary coil and a secondary coil, each coil having an external front, an external back, four external sides and four complimentary internal sides, said internal sides merging with the front and back sides along internal peripheral edges of the coil and merging with each other at internal corners of the coil extending between said peripheral edges, each coil being free of an internal coil bobbin on which said coil is wound;

a laminated iron core having a leg inside said coils;

electrical insulation covering a substantial length of the leg of said core;

two one-piece plastic insulation covers on each of said primary and secondary coils, each cover being fitted over the front, the back and a respective opposing extreme side of its associated coil, each plastic insulation cover being shaped like a U with two side legs, each side leg covering a respective one of the external front and external back of said coil, and a portion between said side legs covering one of said opposing sides of said coil, each plastic insulation cover further comprising a flange on the inside of each of said side legs arranged such that said insulation cover has snap-fit engagement with its associated coil and by which flanges each said cover is fitted tightly against the front, back and both sides of its associated coil after each said cover is snapped thereon, each flange and respective side leg being one continuous piece and covering the internal peripheral edges of said coil at (i) the complimentary internal side of the external side covered by said cover, (ii) a portion of each of the internal sides adjacent said complimentary side and (iii) the corners between said complementary internal side and said adjacent internal sides;

two laminated iron bars adjacent said insulation covers; and two laminated iron shunts between said primary and secondary coils, said shunts completing the flux paths for said coils in conjunction with said two iron bars.

7. A transformer in accordance with claim 6, wherein said plastic insulation covers insulate the back of said primary coil and the front of said secondary coil from said two shunts.

8. An apparatus, comprising:

an electric coil having an external front, an external back, four external sides and four complementary internal sides, said internal sides merging with the front and back sides along internal peripheral edges of the coil and merging with each other at internal corners of the coil extending between said peripheral edges, said coil being free of an internal coil bobbin on which said coil is wound; and two one-piece plastic insulation covers, each cover being fitted over the front, the back and a respective opposing external side of said coil, each plastic insulation cover being shaped like a U with two side legs, each side leg covering a respective one of the external front and external back of said coil and a portion between said side legs covering one of said opposing external sides of said coil, each plastic insulation cover further comprising a flange on the inside of each of said side legs arranged such that said insulation cover has a snap-fit engagement with said coil and by which flanges each said cover is fitted tightly against the front, back and both sides of said coil after each said cover is snapped on to said coil, each flange and respective side leg being one continuous piece and covering the internal peripheral edges of said coil at (i) the complimentary internal side of the external side covered by said cover, (ii) a portion of each of the internal sides adjacent said complimentary side and (iii) the corners between said complimentary internal side and said adjacent internal sides.

* * * * *